US005240625A

United States Patent [19]

O'Connor

[11] Patent Number: 5,240,625

[45] Date of Patent: Aug. 31, 1993

[54] LUBRICATING OIL ADDITIVES

[75] Inventor: Sean P. O'Connor, North Humberside, England

[73] Assignee: BP Chemicals (Additives) Limited, London, United Kingdom

[21] Appl. No.: 496,216

[22] Filed: Mar. 20, 1990

[30] Foreign Application Priority Data

Mar. 23, 1989 [GB] United Kingdom ..... 8906724

[51] Int. Cl.[5] ..... C10M 129/70; C10M 129/95

[52] U.S. Cl. ..... 252/48.6; 252/47.5; 252/39; 252/41; 560/130; 560/206

[58] Field of Search ..... 252/47.5, 39.41, 48.4, 252/48.6, 56 R; 260/399, 401; 560/130, 206; 564/204

[56] References Cited

U.S. PATENT DOCUMENTS

| | | | |
|---|---|---|---|
| 2,223,129 | 11/1940 | Prutton | 252/32 |
| 2,619,482 | 11/1952 | Beare et al. | 260/137 |
| 3,368,972 | 2/1968 | Otto | 252/47.5 |
| 3,390,086 | 6/1968 | O'Halloran | 252/47.5 |
| 3,730,485 | 5/1973 | Strang et al. | 252/48.6 |
| 3,740,333 | 6/1973 | Hutchinson et al. | 252/48.6 |
| 3,743,623 | 7/1973 | Kleiner | 252/48.6 |
| 3,745,147 | 7/1973 | Kleiner | 252/48.6 |
| 3,755,176 | 8/1973 | Kinney et al. | 252/48.6 |
| 3,850,825 | 11/1974 | Vienna et al. | 252/48.6 |
| 3,915,873 | 10/1975 | Kennedy | 252/48.6 |
| 3,953,347 | 4/1976 | Habiby | 252/48.6 |
| 3,986,966 | 10/1976 | Wakin | 252/48.6 |
| 4,089,792 | 5/1978 | Lowe | 252/47 |
| 4,161,475 | 7/1979 | Davis | 252/47 |
| 4,180,466 | 12/1979 | Newingham | 252/48.6 |
| 4,189,389 | 2/1980 | Soula | 252/51.5 A |
| 4,234,435 | 11/1980 | Meinhardt et al. | 252/47.5 |
| 4,237,020 | 12/1980 | Papay | 252/47.5 |
| 4,344,854 | 8/1982 | Davis et al. | 252/47 |
| 4,380,498 | 4/1983 | Kammann, Jr. et al. | 252/48.6 |
| 4,380,499 | 4/1983 | Kammann, Jr. et al. | 252/48.6 |

FOREIGN PATENT DOCUMENTS

| | | |
|---|---|---|
| 281692 | 9/1988 | European Pat. Off. . |
| WO87/833 | 2/1987 | World Int. Prop. O. . |

*Primary Examiner*—Margaret Medley
*Attorney, Agent, or Firm*—Brooks Haidt Haffner & Delahunty

[57] ABSTRACT

A lubricating oil additive suitable as an extreme pressure/anti-wear additive comprises the product obtainable by reacting at elevated temperature a mixture comprising (i) sulphur, (ii) at least one $C_{10}$ to $C_{100}$ unsaturated carboxylic acid, and (iii) at least one hydrocarbyl-substituted phenol, the amount of (iii) in the mixture being 15 to 65% w/w based on the combined weight of (i) (ii) and (iii). The reaction mixture can further comprise an olefin and/or, a mercaptan and/or a lubricating oil as a diluent. The additive is also useful as an anti-oxidant. Additive concentrates and lubricating oil compositions comprise a lubricating oil and the additives of the present invention.

15 Claims, No Drawings

LUBRICATING OIL ADDITIVES

The present invention relates to additives suitable for use as extreme pressure (EP)/anti-wear (AW) additives and/or antioxidants in lubricating oil compositions and/or AW/lubricity agents and/or antioxidants in middle distillate fuels compositions and to lubricating oil compositions and middle distillate fuels compositions containing such.

The use of zinc dialkyl dithiophosphates (ZDTPs) as additives in lubricating oils for the purpose of improving the wear and corrosion characteristics of the oil has long been known from, for example GB Patents Nos. 957,017; 1,358,478 and 1,565,961.

Despite the fact that ZDTPs have been very effective and very successful in a number of engine lubricating oils, it is presently considered desirable to reduce the phosphorus content of the finished lubricating oil by the provision of alternative and/or supplementary additives for the purpose of reducing environmental pollution.

The use of sulphurised materials as EP/AW additives in lubricating oil compositions is also well-known from, for example, U.S. Pat. Nos. 3,953,347, 3,953,347 discloses sulphurised compositions prepared by reacting, at about 100° to 250° C., sulphur with a mixture comprising (A) 100 parts by weight of at least one fatty acid ester, (B) about 0 to 50 parts by weight of at least one fatty acid, and (C) about 25 to 400 parts by weight of at least one aliphatic olefin containing about 8 to 36 carbon atoms.

U.S. Pat. No. 3,915,873 relates to a lubricating composition comprising a major amount of oil and an antiwear amount of a cosulphurised $C_7$–$C_{40}$ alkyl phenol and fatty acid ester of a $C_{10}$–$C_{30}$ fatty acid and a $C_1$–$C_{30}$ alkanol or alkenol.

According to the present invention there is provided an additive suitable for use as an extreme pressure/anti-wear additive in lubricating oil comprising the product obtainable by reacting at elevated temperature a mixture comprising (i) sulphur, (ii) at least one $C_{10}$ to $C_{100}$ unsaturated carboxylic acid, or amide or acid salt thereof and (iii) at least one hydrocarbyl-substituted phenol, the amount of (iii) in the mixture being 15 to 65% by weight based on the combined weight of (i) (ii) and (iii).

The present invention also provides an additive suitable for use as an extreme pressure/anti-wear additive in lubricating oil comprising the product obtainable by reacting at elevated temperature a mixture comprising (i) sulphur, (ii) at least one $C_{10}$ to $C_{100}$ unsaturated carboxylic acid and (iii) at least one hydrocarbyl-substituted phenol, the amount of (i) in the mixture being from 1 to 25% by weight based on the combined weight of (ii) and (iii), the amount of (ii) in the mixture being 20 to 85% by weight based on the combined weight of (i), (ii) and (iii), and the amount of (iii) in the mixture being 15 to 65% by weight based on the combined weight of (i), (ii) and (iii).

Sulphur (component (i)) is preferably in the form of elemental sulphur, although other sources can be used for example sulphur monohalides or sulphur dihalides.

The unsaturated carboxylic acid (component (ii)) is preferably a $C_{14}$ to $C_{22}$ unsaturated carboxylic acid. It may be a straight-chain or branched-chain acid and may be mono-, di- or poly-unsaturated. The acid may be mono-, di- or poly-basic. Examples of suitable acids include oleic acid, linoleic acid, linolenic acid, and the like. Mixtures of acids, for example rape top fatty acid and tall oil fatty acid, may also be employed.

Alternatively, or in addition, acid derivatives, for example amides, or acid salts e.g. of calcium or sodium may be used.

The hydrocarbyl-substituted phenol (component (iii)) may suitably be an alkyl phenol. The alkyl substituent (or substituents) of the alkyl phenol may suitably be $C_8$ to $C_{100}$, preferably $C_8$ to $C_{24}$, alkyl groups which may be straight-chain or branched-chain. The alkyl phenol may be a monoalkyl phenol or a polyalkyl phenol; where the alkyl phenol is a polyalkyl phenol it is preferably a dialkyl phenol; a particularly suitable dialkyl phenol is dinonyl phenol. The alkyl group (or groups) may be ortho, meta or para in relation to the hydroxyl function of the phenol.

In addition to the components (i) to (iii) the mixture may also contain at least one olefin and/or at least one mercaptan and/or a lubricating oil as a diluent.

The olefin may be either a mono-, di- or polyolefin, which may contain from 6 to 100 carbon atoms. Both internal and terminal olefins may be employed. Suitable olefins include $C_{18}$-alpha olefins, propylene tetramer, isobutene oligomers and polyisobutenes.

Both aliphatic and aromatic mercaptans may be employed. Examples of suitable mercaptans include 1-dodecanethiol, 2-mercaptobenzothiazole and 2,5-dimercapto-1,3,4-thiadiazole.

The olefin and/or mercaptan and/or lubricating oil as a diluent may suitably be present in an amount sufficient to provide from 0 to 65% by weight in the final product.

Sulphurisation promoters may also be employed if desired. Suitable promoters include organic or inorganic bases, aliphatic alcohols, glycols and glycolethers. Examples of suitable promoters include diphenylamine, dibutylamine, calcium hydroxide, sodium hydroxide, butanol, ethylene glycol, 1,2-propane diol and methyldiglycol, preferably diphenylamine.

The elevated temperature at which the mixture is reacted may suitably be in the range from 100 to 250, preferably from 130° to 200° C. Reaction may suitably be carried out at atmospheric pressure, optionally with agitation and/or nitrogen sparging. Alternatively, elevated pressure may be employed.

Finally, it is preferred to filter the product.

In another aspect the present invention provides a lubricating oil composition comprising a major proportion of an lubricating oil base stock and a minor proportion of the additive as hereinbefore described.

The amount of the additive present in the lubricating oil composition will vary depending on the nature of the lubricating oil base stock and its field of application, for example automotive, marine or industrial, but will generally be in the range from 0.01 to 10%, more generally from 0.1 to 5% w/w.

The lubricating oil base stock may be any oil of lubricating viscosity, which may be a mineral oil or a synthetic lubricating oil. Suitable mineral oils include both solvent extracted or solvent refined oils obtained in accordance with conventional methods of treating lubricating oils. The base oil may be derived from paraffinic, naphthenic, asphaltic or mixed base crudes. Alternatively, the base oil may be a synthetic oil, or a mixture thereof with mineral oil.

In addition, the lubricating oil composition may contain conventional additives, for example dispersants, detergents, VI improvers, anti-oxidants, pour-point depressants, or the like.

The additives of the present invention have good EP/AW and antioxidant properties, as will be demonstrated hereinafter, and maintain good compatibility with other lubricating oil additives and base oils. Moreover, they are essentially non-corrosive to copper and engine bearings.

Lubricating oil additives are generally manufactured and marketed in the form of a concentrate for subsequent blending into finished lubricating oils.

In another embodiment of the invention there is provided a lubricating oil additive concentrate for use in the production of finished lubricating oils which comprises a lubricating oil base stock and an additive as hereinbefore described in a concentration of from 2 to 20% w/w based on the weight of the additive concentrate.

The lubricating oil base stock may be any of the aforedescribed lubricating oils, but is preferably a solvent neutral oil. As an alternative to incorporating conventional additives directly in the finished lubricating oil composition some or all of them may be incorporated with the additive in the additive concentrate.

The invention will now be further illustrated by reference to the following Examples and Comparison Tests; the latter, although not illustrative of the invention, are included only for purposes of comparison.

(A) PREPARATION OF ADDITIVES

EXAMPLE 1

(a) Reaction Mixture $C_{12}$-alkyl phenol=92.0 g
Rape top fatty acid=232.0 g
$C_{18}$-alpha olefin=84.1 g
Diphenylamine=2.5 g
Sulphur=51.7 g (b) Method (i) The reaction mixture (a) was heated to 180° -190° C. and held at this temperature for 20 hours with a nitrogen sparge.
(ii) The mixture was stripped at 150° C./10 mm Hg/60 minutes.
(iii) The reaction product was filtered.

(c) Product Weight

Crude product=405 g (d) Product Composition

Sulphur=8.81% w/w
Alkyl phenol=22.7% w/w

EXAMPLE 2

(a) Reaction Mixture $C_{12}$-alkyl phenol=84.0 g
Rape top fatty acid=92.8 g
$C_{18}$-alpha olefin=0 g
Diphenylamine=2 g
Sulphur=20.6 g Method (b) The procedure of Example 1(b) was repeated.

(c) Product Weight

Crude product=177 g (d) Product Composition

Sulphur=7.49% w/w
Alkyl phenol=47.5% w/w

Comparison Test 1

(a) Reaction Mixture $C_{12}$-Alkyl phenol=0 g
Rape top fatty acid=1000.0 g
$C_{18}$-alpha olefin=0 g
Diphenylamine=0 g
Sulphur=113.3 g (b) Method The procedure of Example 1(b) was repeated except that in step (ii) the mixture was stripped at 200° C. instead of 150° C.

(c) Product Weight

Crude product=972 g (d) Product Composition

Sulphur=9.40% w/w
Alkyl phenol=0% w/w

Comparison Test 2

(a) Reaction Mixture $C_{12}$-Alkyl phenol=7.8 g
Rape top fatty acid=81.2 g
$C_{18}$-alpha olefin=0 g
Diphenylamine=0.9 g
Sulphur=10.1 g (b) Method The procedure of Example 1(b) was repeated.

(c) Product Weight

Crude product=89 g (d) Product Composition

Sulphur=9.10% w/w
Alkyl phenol=8.8% w/w

Comparison Test 3

(a) Reaction Mixture $C_{12}$-Alkyl phenol=42.7 g
Rape top fatty acid=280.9 g
$C_{18}$-alpha olefin=84.1 g
Diphenylamine=2.5 g
Sulphur=51.7 g (b) Method The procedure of Example 1(b) was repeated.

(c) Product Weight

Crude product=414 g (d) Product Composition

Sulphur=8.95 g
Alkyl phenol=10.3% w/w

Comparison Test 4

(a) Reaction Mixture $C_{12}$-Alkyl phenol=344.2 g
Rape top fatty acid=0 g
$C_{18}$-alpha olefin=0 g Diphenylamine=0 g
Sulphur=68.8 g
Ethylene glycol=76.5 g
Lime=8.4 g (b) Method (i) The reaction mixture (a) was stirred at 165° C. for 1 hour.
(ii) The mixture was stripped at 200° C./10 mm Hg/90 minutes.
(iii) The product was filtered.

(c) Product Weight

Crude product=380 g (prior to filtration)
Lights=90 g (d) Product Composition

Sulphur=9.5% w/w
Alkyl phenol=90.6% w/w

Comparison Tests 1 to 4 are not examples in accordance with the present invention because the alkyl phenol content in the mixture was not in the range from 15 to 65% w/w based on the combined weight of sulphur, carboxylic acid and phenol in the mixture as hereinbefore defined. The Tests are included only for the purpose of comparison.

(B) TESTING OF ADDITIVE COMPOSITIONS

Shell-Seta Four-Ball Test

The products of Examples 1 and 2 and Comparison Tests 1 to 3 were diluted with SN150 base oil. In addition, commercially available ZDTP was also diluted with 150SN base oil. The diluted additive compositions were tested for EP/AW properties in the Shell-Seta Four-Ball Test. This test involved pressing a rotating steel ball against a triangle of three stationary balls lubricated with the composition under test. The Initial Seizure Load (ISL), the Weld Load (WL) and the Scar Size after 1 hour at 40 kg load (AW) were determined. The results of the Test are given in Table 1.

Rotary Bomb Oxidation Test

The products of Examples 1 and 2 and Comparison Tests 1 to 4 and a ZDTP (identical to that used above) all diluted with SN150 base oil as in the Shell-Seta Four Ball Test were tested for antioxidant activity in the Rotary Bomb Oxidation Test. The time taken to achieve a 25 psi oxygen pressure drop (T) was determined. The results are given in Table 2.

Copper Strip Test

The products of Examples 1 and 2 and Comparison Tests 1 to 4 and a ZDTP (as used in the previous tests) all diluted with SN150 base oil as in the Shell-Seta Four Ball Test were tested for their corrosivity to copper in the Copper Strip Test. The copper strip ratings were determined at 150° C. after 3 hours in conventional manner according to the following:

1A–1B slight tarnish
2A–2F moderate tarnish
3A–3B dark tarnish
4–4C corrosion

The results of the Test are given in Table 2.

TABLE 1

| REFERENCE | CONCN wt % in SN150 | ISL kg | WL kg | AW mm |
|---|---|---|---|---|
| Example 1 | 0.3 | 105 | 150 | 0.85 |
| Example 2 | 0.3 | 110 | 150 | 0.68 |
| Comp. Test 1 | 0.3 | 73 | 150 | 0.32 |
| Comp. Test 2 | 0.3 | 75 | 160 | 0.34 |
| Comp. Test 3 | 0.3 | 100 | 140 | 0.65 |
| ZDTP | 1.0 | 85 | 140 | ND |
| SN150 | — | 40 | 117 | 1.75 |

The results presented in Table 1 demonstrate that the additive compositions according to the invention are superior EP/AW agents to the Comparison Test additive compositions and the ZDTP.

TABLE 2

| REFERENCE | CONCN % in SN150 | RBOT T mins | COPPER STRIP RATING |
|---|---|---|---|
| Example 1 | 0.3 | 92.5 | 1B |
| Example 2 | 0.3 | 84.0 | 1B |
| Comp. Test 1 | 0.3 | 35.3 | 1B |
| Comp. Test 2 | 0.3 | 33.5 | 1B |
| Comp. Test 3 | 0.3 | 35.5 | 1B |
| Comp. Test 4 | 0.3 | 33.5 | 3B (1.0%) |
| ZDTP | 0.3 | 80.0 | ND |
| SN150 | — | 25.5 | 1B |

The results presented in Table 2 demonstrate that the additives according to the invention have significantly improved antioxidant properties as compared with the Comparison Test additives and are roughly equal in antioxidant performance to the ZDTP. The additive according to the invention are no more corrosive to copper than the additives of the Comparison Tests.

I claim:

1. An additive suitable for use as an extreme pressure/antiwear additive in lubricating oil comprising the product obtained by reacting at elevated temperature a mixture comprising (i) sulphur, (ii) at least one $C_{14}$ to $C_{22}$ unsaturated carboxylic acid, and (iii) at least one hydrocarbyl-substituted phenol, the amount of (iii) in the mixture being 15 to 65% w/w based on the combined weight of (1) (ii) and (iii).

2. An additive as claimed in claim 1 wherein the amount of (i) in the mixture is 1 to 25% w/w based on the combined weight of (ii) and (iii) in the mixture.

3. An additive as claimed in claim 2 wherein (i) is elemental sulfur.

4. An additive as claimed in claim 1 wherein (i) is elemental sulphur.

5. An additive as claimed in claim 1 wherein (iii) is a mono or dialkyl phenol.

6. An additive as claimed in claim 1 wherein said mixture further contains a $C_6$–$C_{100}$ olefin in an amount up to 65% w/w as a diluent.

7. An additive as claimed in claim 6 wherein said olefin is a $C_{18}$ alpha olefin.

8. An additive as claimed in claim 1 wherein said mixture further contains a mercaptan in an amount up to 65% w/w as a diluent.

9. An additive as claimed in claim 1 wherein said mixture further contains from 0–65% w/w of a lubricating oil in an amount up to 65% w/w as a diluent.

10. An additive as claimed in claim 1 wherein (iii) is a $C_8$–$C_{24}$ alkyl phenol.

11. An additive as claimed in claim 1 wherein said mixture further contains up to 65% w/w of one or more of a mercaptan, a $C_6$–$C_{100}$ olefin, or a lubricating oil.

12. An additive as claimed in claim 11 wherein said olefin is a $C_{18}$ alpha olefin.

13. A lubricating oil composition comprising a lubricating oil and an additive as claimed in claim 11, said additive being present in an amount from 0.01 to 10% w/w based on the weight of the composition.

14. An additive concentrate comprising a lubricating oil and an additive as claimed in claim 1 said additive being present in an amount from 2 to 20% w/w based on the weight of the concentrate.

15. A lubricating oil composition comprising a lubricating oil and an additive as claimed in claim 1 said additive being present in an amount from 0.01 to 10% w/w based on the weight of the composition.

* * * * *

UNITED STATES PATENT AND TRADEMARK OFFICE

CERTIFICATE OF CORRECTION

PATENT NO. : 5,240,625
DATED : August 31, 1993
INVENTOR(S) : SEAN P. O'CONNOR

It is certified that error appears in the above-indentified patent and that said Letters Patent is hereby corrected as shown below:

Col. 1, l. 24, there should be a period after the first U.S. Pat. Nos. 3,953,347.

Col. 5, l. 67, should read "4A-4C"

Signed and Sealed this

Twenty-fourth Day of May, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,240,625

DATED : Aug. 31, 1993

INVENTOR(S) : Sean P. O'Connor

It is certified that error appears in the above-indentified patent and that said Letters Patent is hereby corrected as shown below:

Column 6, claim 9, line 65, should read --mixture further contains a lubricat- --.

Signed and Sealed this

Twentieth Day of September, 1994

*Attest:*

Bruce Lehman

BRUCE LEHMAN

*Attesting Officer*

*Commissioner of Patents and Trademarks*